US010704565B2

(12) United States Patent
Kösters

(10) Patent No.: US 10,704,565 B2
(45) Date of Patent: Jul. 7, 2020

(54) SIDE-CHANNEL PUMP

(71) Applicant: STERLING INDUSTRY CONSULT GMBH, Itzehoe (DE)

(72) Inventor: Heiner Kösters, Itzehoe (DE)

(73) Assignee: STERLING INDUSTRY CONSULT GMBH, Itzehoe (DE)

( * ) Notice: Subject to any disclaimer, the term of this patent is extended or adjusted under 35 U.S.C. 154(b) by 268 days.

(21) Appl. No.: 15/319,900

(22) PCT Filed: Jun. 18, 2015

(86) PCT No.: PCT/EP2015/063741

§ 371 (c)(1),
(2) Date: Dec. 19, 2016

(87) PCT Pub. No.: WO2015/197467

PCT Pub. Date: Dec. 30, 2015

(65) Prior Publication Data

US 2017/0130735 A1 May 11, 2017

(30) Foreign Application Priority Data

Jun. 24, 2014 (EP) ..... 14173691

(51) Int. Cl.
*F04D 29/58* (2006.01)
*F04D 13/06* (2006.01)
(Continued)

(52) U.S. Cl.
CPC ..... *F04D 29/5806* (2013.01); *F04D 1/00* (2013.01); *F04D 5/002* (2013.01); *F04D 5/006* (2013.01);
(Continued)

(58) Field of Classification Search
CPC ... F04D 1/00; F04D 1/06; F04D 29/58; F04D 29/5806; F04D 29/5813; F04D 29/586;
(Continued)

(56) References Cited

U.S. PATENT DOCUMENTS 3,124,077 A * 3/1964 White ..... F04D 5/006 415/169.1
3,385,225 A * 5/1968 Hagemann ..... F04D 5/006 415/143
(Continued)

FOREIGN PATENT DOCUMENTS

CN 2823602 Y 10/2006
CN 202659519 U 1/2013
(Continued)

OTHER PUBLICATIONS

International Search Report dated Sep. 10, 2015 in corresponding Application No. PCT/EP2015/063741; 4 pgs.
(Continued)

*Primary Examiner* — Philip E Stimpert
(74) *Attorney, Agent, or Firm* — Maier & Maier, PLLC

(57) ABSTRACT

A side-channel pump having a pump housing in which an operating chamber which is provided with a side channel and a motor are arranged, and having an impeller in the operating chamber which rotates with a shaft which is driven by the motor. A cooling circuit extends from the operating chamber to the motor and from the motor to a suction portion of the pump, wherein the cooling circuit is supplied from an operating chamber whose outlet side is connected to an outlet opening of the side-channel pump. Using the pump, gas can be drawn in without the pump becoming overheated.

11 Claims, 2 Drawing Sheets

Figure 1:
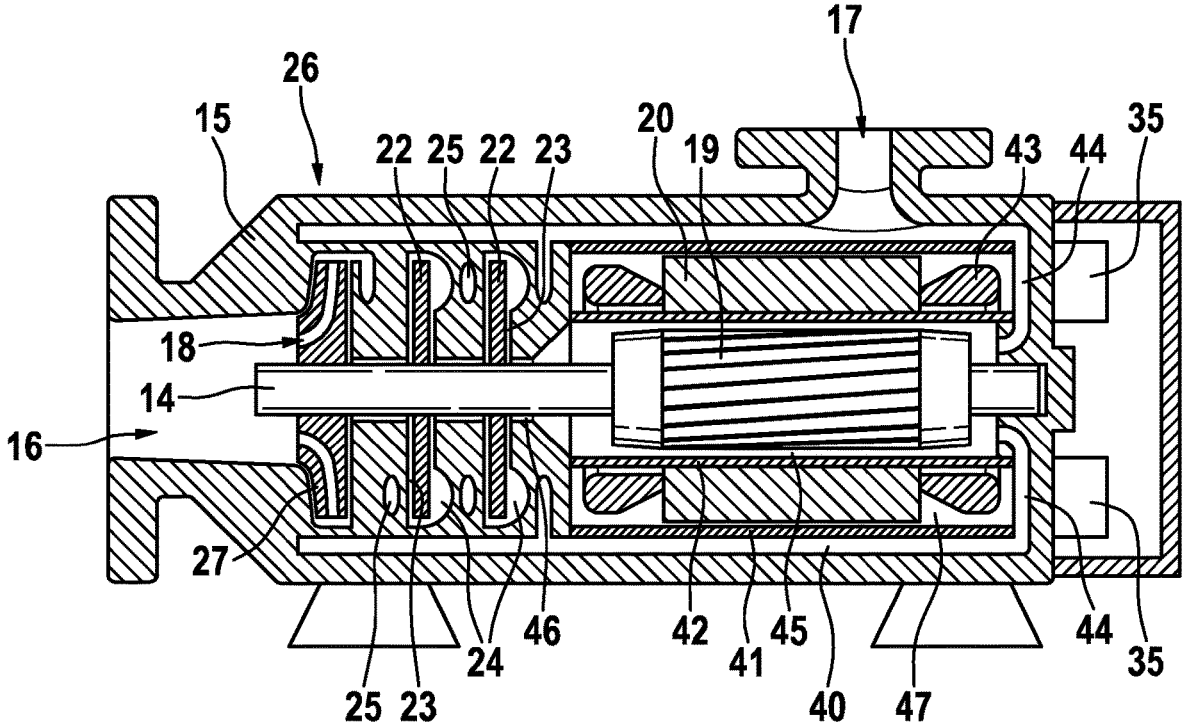

(51) Int. Cl.

| | |
|---|---|
| ***F04D 5/00*** | (2006.01) |
| ***F04D 1/00*** | (2006.01) |
| ***F04D 15/00*** | (2006.01) |
| ***F04D 29/22*** | (2006.01) |
| ***F04D 29/42*** | (2006.01) |
| ***F04D 31/00*** | (2006.01) |

(52) U.S. Cl.
CPC ..... *F04D 13/06* (2013.01); *F04D 15/0066* (2013.01); *F04D 29/22* (2013.01); *F04D 29/42* (2013.01); *F04D 29/588* (2013.01); *F04D 29/5813* (2013.01); *F04D 31/00* (2013.01)

(58) Field of Classification Search
CPC ..... F04D 29/588; F04D 31/00; F04D 5/002; F04D 5/003; F04D 5/006; F04D 5/008; F04D 7/02; F04D 7/04; F04D 13/06; F04D 13/0606; F04D 29/042
USPC ..... 417/423.8, 423.11, 366
See application file for complete search history.

(56) References Cited

U.S. PATENT DOCUMENTS

| | | | | |
|---|---|---|---|---|
| 6,296,690 | B1 * | 10/2001 | Charron | E21B 43/121 95/248 |
| 6,390,789 | B1 * | 5/2002 | Grob | F04D 17/12 417/251 |
| 6,422,838 | B1 * | 7/2002 | Sloteman | F04D 13/0666 415/101 |
| 2012/0153620 | A1 * | 6/2012 | Artinian | F04D 29/048 290/52 |
| 2014/0017073 | A1 | 1/2014 | Muizelaar et al. | |
| 2015/0184674 | A1 * | 7/2015 | Lee | F04D 13/0686 417/366 |

FOREIGN PATENT DOCUMENTS

| | | | | |
|---|---|---|---|---|
| DE | 1 098 820 B | | 2/1961 | |
| DE | 1098820 B | * | 2/1961 | F04D 1/066 |
| EP | 0 831 236 A2 | | 3/1998 | |
| KR | 10-1332853 B1 | | 11/2013 | |

OTHER PUBLICATIONS

Office Action and Search Report dated Jul. 3, 2018 in corresponding Chinese Patent Application No. 201580034236.X; 15 pages including English-language translation.

Office Action dated Mar. 4, 2019 in corresponding Chinese Application No. 201580034236.X; 19 pages including English-language translation.

European Office Action dated Oct. 8, 2019, in connection corresponding EP Application No. 15729508.0 (8 pgs., including machine-generated English translation).

* cited by examiner

SIDE-CHANNEL PUMP

The invention relates to a side-channel pump having a pump housing. There are arranged in the pump housing an operating chamber which is provided with a side channel and a motor. An impeller in the operating chamber rotates with a shaft which is driven by the motor.

Side-channel pumps have been known per se for some time (DE 855 363). They are used to convey liquids and admixtures of liquids and gas. It is an advantage of side-channel pumps that the operation of the pump is impaired only in an insignificant manner when relatively large quantities of gas are also carried in the liquid.

It is further known that initially pure gas can be conveyed using side-channel pumps in order to consequently draw in the liquid which is intended to be conveyed into the pump. This is also possible when the operating chamber is dry, that is to say, initially a quantity of liquid is not contained in the operating chamber, WO 2014/033317 A1. To this end, the pump is operated at high speed so that it operates in the manner of a fan.

In this operating state, there is the risk that the side-channel pump may become overheated. On the one hand, the high speed is linked with a high level of heat development. On the other hand, only small quantities of heat are discharged as long as no liquid has yet arrived in the pump.

An object of the invention is to provide a side-channel pump which does not become overheated when drawing in gas. Based on the mentioned prior art, the object is achieved with the features of claim 1. Advantageous embodiments are set out in the dependent claims.

According to the invention, the side-channel pump comprises a cooling circuit which extends from the operating chamber to the motor and from the motor to a suction portion of the pump.

Firstly, a few terms will be explained. When the side-channel pump draws in gas, the gas is compressed in the operating chamber so that there is a higher pressure in the operating chamber than at the inlet of the pump. The term suction portion is intended to refer to a region of the pump from which the medium is conveyed to the outlet of the pump and in which the pressure is lower than in the portion of the operating chamber from which the cooling circuit is supplied.

The invention has recognized that a portion of the conveyed medium can be used as a cooling medium. By the cooling being constructed as a closed circuit, in which the cooling medium is conveyed from the operating chamber to the motor and again to a suction portion of the pump, there can be maintained a constant flow of the cooling medium by means of which heat can be discharged from the motor. The invention has in particular recognized that the coolant circuit also has an effect when gaseous medium is conveyed. Although the cooling is generally not so effective that it would enable a permanent operation of the side-channel pump, this is also unnecessary since it is necessary to bridge only the period of time until the liquid which has been drawn in follows the gas. To this end, it is sufficient for dry operation to be possible for a period of time in the order of magnitude of minutes. This is many times longer than with conventional pumps which become overheated within a few seconds when no liquid medium is conveyed.

The greater the pressure difference which is present over the cooling circuit is, the greater is the flow of the cooling medium and the more effective is the cooling. However, the cooling circuit also at the same time constitutes a leakage flow as a result of which the degree of efficiency of the pump is reduced. It is consequently desirable to allow no more cooling medium than necessary to flow through the cooling circuit. In a preferred embodiment, the pressure difference which is present over the cooling circuit is therefore smaller than the pressure difference between the outlet opening of the side-channel pump and the inlet opening of the side-channel pump. In a further preferred manner, the pressure difference which is present over the cooling circuit is not greater than the pressure difference which is present over an operating chamber.

The side-channel pump according to the invention is generally multi-stage, that is to say, comprises a plurality of operating chambers which are provided with side channels. In each of the operating chambers, an impeller rotates. In this instance, the outlet side of a first operating chamber is in each case preferably connected to the inlet side of a subsequent operating chamber.

The cooling circuit can be supplied from an operating chamber, whose outlet side is connected to the outlet opening of the pump. Preferably, the cooling circuit is supplied from the outlet side of the operating chamber. For example, the cooling circuit may branch off from a connection line between the operating chamber and the outlet opening of the pump.

The cooling circuit may open in the same operating chamber from which the cooling circuit is supplied. Another region of the same operating chamber then forms the suction portion in the context of the invention. For example, the cooling circuit may open in a gap of the operating chamber which is formed between the shaft and a portion of the pump housing which surrounds the shaft. Consequently, a gap which would otherwise form a leakage gap is used as a portion of the cooling circuit. The pressure difference present over the cooling circuit is preferably less than 60%, more preferably less than 40% of the pressure difference between the inlet side and the outlet side of the operating chamber which is preferably the operating chamber whose outlet side is connected to the outlet opening.

The cooling circuit is intended to be configured in such a manner that the heat is effectively discharged from the motor. For example, the cooling circuit may extend between the rotor and the stator of the motor.

Preferably, the cooling circuit extends in the longitudinal direction (that is to say, parallel with the shaft) over the entire length of the motor. The length of the motor refers to the portion in which the rotor and the stator cooperate electrically. The flow direction of the cooling medium may be such that the cooling medium approaches the operating chamber as it moves through the motor. The cooling medium can be directed from the operating chamber firstly to the remote end of the motor before it enters the motor.

In the pump housing, there may further be received an electronic control system for the motor. The electronic control system may in particular be configured to control the speed of the motor in a variable manner. The side-channel pump according to the invention is preferably configured in such a manner that, when viewed in the longitudinal direction, the motor is arranged between the electronic control system and the operating chamber.

The cooling circuit may comprise a portion which is arranged between the motor and the electronic control system. In this embodiment, the electronic control system can also be cooled at the same time as the cooling circuit. The cooling circuit may comprise a plurality of channels which are arranged between the electronic control system and the motor. The channels may be orientated in a radial direction. The flow direction of the cooling medium may be such that the cooling medium flows from the outer to the inner side in all channels.

For the effectiveness of the cooling, it is further advantageous for the cooling circuit to be configured in such a manner that it enables an extensive contact between the cooling medium and the motor. An annular gap may be formed between the pump housing and the motor. The annular gap may extend in the peripheral direction around the motor. The cooling circuit may extend through the annular gap. The annular gap may at the same time form a connection channel between the outlet side of an operating chamber and the outlet opening of the side-channel pump.

Preferably, all of the medium which is conveyed with the pump moves through the annular gap. A portion of the medium can be discharged from the annular gap through an outlet opening out of the pump, whilst the other portion moves as cooling medium through the cooling circuit. The cooling medium preferably forms only a small portion of the medium which is conveyed in total. The portion may, for example, be less than 10%, preferably less than 5%.

The motor may therefore be surrounded by an outer pipe which extends in a peripheral direction around the motor. The outer pipe may be in direct physical contact with the stator of the motor. In the longitudinal direction, the outer pipe preferably extends at least over the length of the motor. The outer pipe may adjoin the annular gap and form an inner delimitation for the annular gap. As a result of the extensive contact between the outer pipe and the annular gap, the heat can be effectively discharged.

The motor may comprise an inner pipe which is arranged between the stator and the rotor of the motor. The inner pipe may be in direct physical contact with the stator. A portion of the cooling circuit may extend through an annular gap between the inner pipe and the rotor of the motor. As a result of the extensive contact, the heat may be guided both by the rotor and by the stator of the motor. Furthermore, as a result of such an inner pipe, a direct contact between the stator and the medium which is conveyed can be prevented.

As long as only gas is conveyed, the cooling circuit is generally not sufficient to completely discharge the heat produced in the rotor. The motor thus becomes heated. In order to prevent overheating of the motor, the motor and the surrounding housing may be constructed according to the invention in such a manner that they have a high thermal capacity. The quantity of heat can as a result of the high thermal capacity be absorbed in the motor and the temperature increase is limited.

In particular, the stator may be configured in such a manner that it has a high mass and in connection therewith a high thermal capacity. Preferably, the stator completely fills the gap between the inner pipe and the outer pipe over a longitudinal portion of the motor so that there are no empty spaces with a thermally insulating action. In a further preferred manner, the longitudinal portion extends over the entire length of the motor. A space which surrounds the end windings of the stator can be filled with a casting compound. The inner pipe and the outer pipe of the motor may consequently have the dual action that they, on the one hand, enable an extensive contact with the cooling circuit and, on the other hand, define a space inside which excess quantities of heat can be temporarily stored.

The pump housing may be provided with a ventilation valve which opens when gaseous medium is conveyed and which closes when liquid medium is conveyed. The gaseous medium may be discharged through the ventilation valve so that where possible only liquid medium is conveyed through the outlet opening of the pump. The ventilation valve may be arranged between the outlet side of the operating chamber and the outlet opening of the pump. In a preferred embodiment, the ventilation valve opens in the annular gap between the outer pipe and the pump housing. The pump housing may have a plurality of ventilation valves. One of the ventilation valves may be arranged in an upper portion of the pump housing, another ventilation valve may be arranged in a lower portion of the pump housing.

The pumps according to the invention are often used in installations in which it is very important that the fluid which is conveyed does not penetrate to the outer side. It is advantageous for this purpose to use a side-channel pump which is constructed without any seal. The term "without any seal" is intended to mean that the end of the shaft on which the drive motor acts is completely arranged inside the housing of the pump. Since the shaft is not guided outward through the housing, no shaft seal is required at this location.

In each operating chamber, an impeller rotates. The impeller is enclosed between two end faces of the operating chamber, wherein the side channel is constructed in one of the end faces. The side channel corresponds to a recess in the end face, which means that the leakage gap which exists between the impeller and the end face is increased in the region of the side channel. The side channel may extend in a curved path away from the inlet opening to the outlet opening of the operating chamber. The curved path may substantially correspond to the path which the impeller also describes on the way from the inlet opening to the outlet opening.

When the pump runs with overspeed as a fan and then liquid strikes the inlet stage of the pump, this is linked with a sudden loading of the pump. The inlet stage of the pump is intended to be configured in such a manner that it withstands this sudden loading. For example, the inlet stage may be a centrifugal stage. With a centrifugal stage, an impeller wheel is provided with a plurality of channels which extend from a central region of the impeller to a peripheral region of the impeller. The pump action of such a centrifugal stage results from the fact that the conveyed medium moves under the action of the centrifugal force through the channel from the central region to the peripheral region.

When the medium strikes the inlet stage in an axial direction, the medium is thus redirected so that it moves in a radial direction. In the method according to the invention, this has the advantage that the momentum from the liquid which strikes the inlet stage acts substantially in an axial direction. Forces in a radial direction, by means of which the pump could be caused to oscillate, are substantially avoided. In this context, it is further advantageous for the channels to be distributed in an identical manner over the periphery of the impeller.

Since the drive power is low during operation at overspeed, the pump is swiftly braked as soon as the liquid has entered the inlet stage. Before the liquid enters the following stages which are provided with an impeller and side channel, the speed has already considerably decreased so that the subsequent stages are subjected to the sudden loading only to a reduced extent.

The side-channel pump according to the invention is provided with a control system which is configured to operate the pump with an overspeed when the operating chamber of the pump is filled with gas and to reduce the speed to an operating speed when liquid enters the pump. It is possible for the control system to be configured in such a manner that it brings about an active braking of the pump.

However, this is not necessary. As soon as liquid enters the pump, the resistance increases so that the speed of the pump is also decreased if the drive power remains unchanged. The drive motor is generally configured in such a manner that it cannot keep the pump at the overspeed even during operation at maximum power after liquid has entered the pump. The control system may therefore be configured in such a manner that, after the liquid has entered, it waits until the speed has been automatically reduced to the desired operating speed and then increases the drive power so that the pump is constantly kept at the operating speed.

A preferred field of application of the pump according to the invention is conveying liquid gas from a tank. This takes place, for example, at LPG filling stations where vehicles which are operated with liquid gas are filled from a tank which is often recessed in the ground. The tank is partially filled with liquid gas in the liquid state; the upper portion of the tank and in particular the line which leads to the pump according to the invention are taken up by evaporated liquid gas. The pressure in the tank and the line therefore corresponds to the vapor pressure of the liquid gas when the pump is non-operational.

If the pump is operated the vapor of the liquid gas is drawn in. This first results in the pressure in the line decreasing and additional liquid gas thereby changing into the gaseous state. If the pump has only a low suction power, this continues in this manner and only the newly evaporated gas is continuously conveyed. However, the suction power of the pump according to the invention is great enough to also achieve a reduction of the temperature in the line, which leads to the vapor pressure in the line being lower than the vapor pressure in the tank. As a result of the pressure difference, the liquid rises out of the tank into the line and can be drawn in by the pump. With the method according to the invention, it is therefore also possible to convey the liquid gas out of the tank in liquid form. This even works when the tank is arranged lower than the pump, the line which extends out of the tank to the pump is therefore a rising line through which the liquid gas has to be conveyed counter to gravitational force. As soon as the liquid strikes the inlet stage of the pump, the speed of the pump is reduced from overspeed to operating speed and the liquid is conveyed during conventional operation of the pump.

Figure 2:
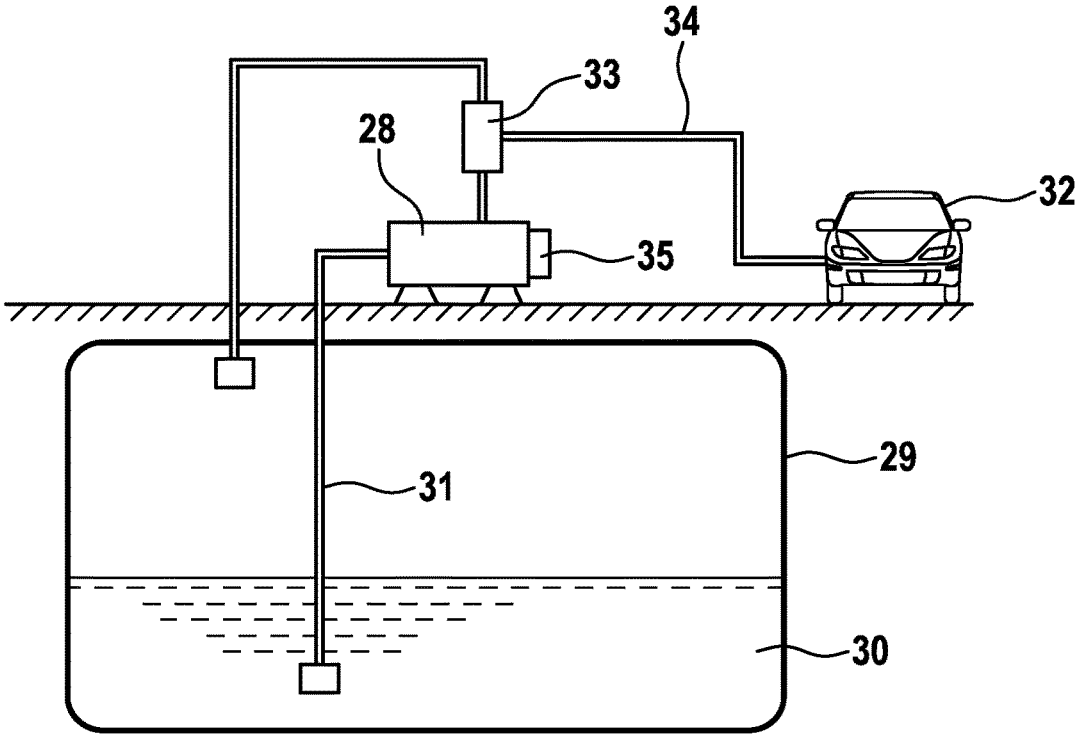
Figure 3:
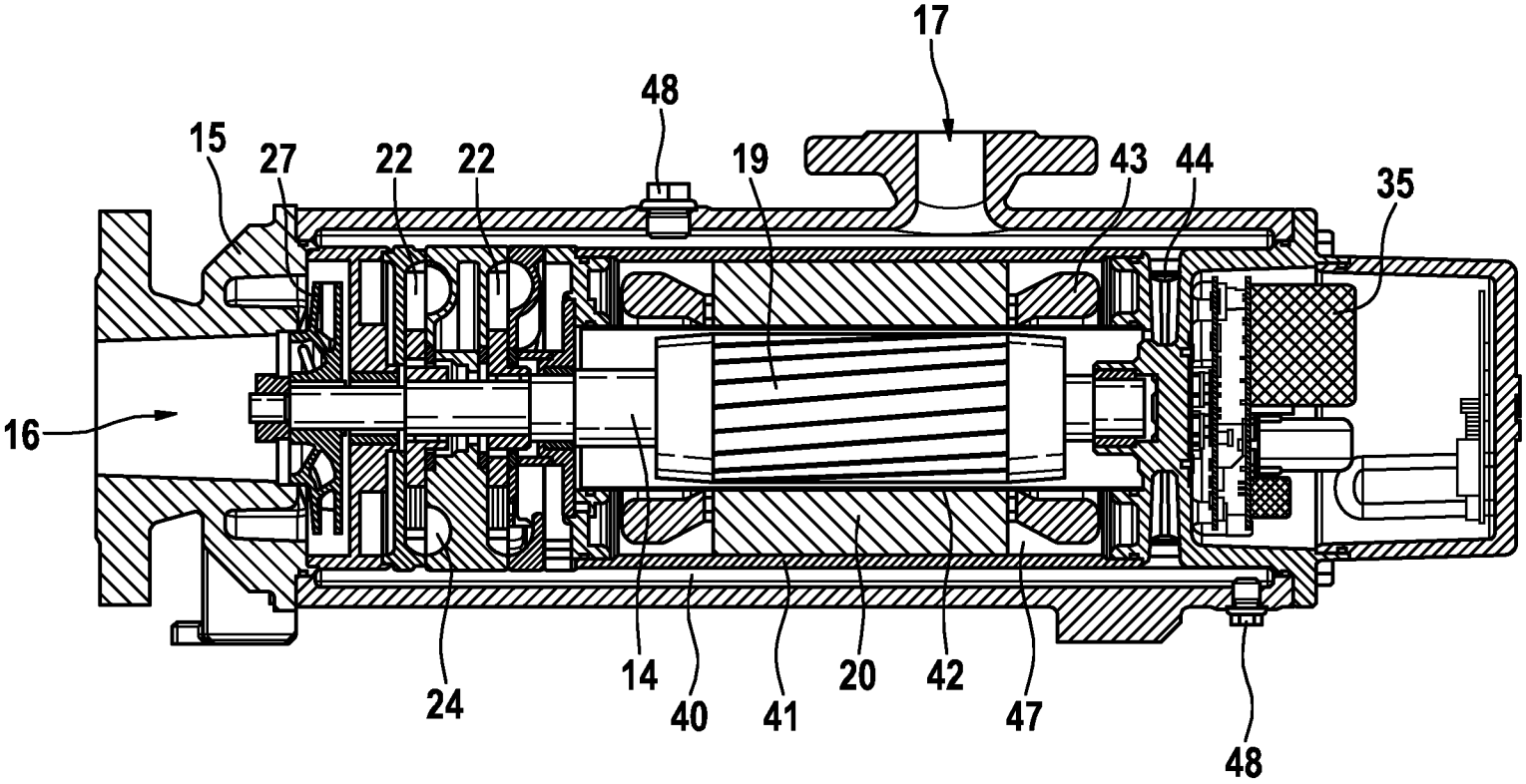

The invention is described by way of example below with reference to the appended drawings and advantageous embodiments. In the drawings:

FIG. 1: is a schematic illustration of a side-channel pump according to the invention;

FIG. 2: shows an arrangement of a side-channel pump according to the invention and a liquid gas tank; and FIG. 3: shows another embodiment of a side-channel pump according to the invention.

In a side-channel pump according to the invention in FIG. 1, a shaft 14 is rotatably supported in a pump housing 15. The pump housing 15 is provided with an inlet opening 16 and an outlet opening 17, wherein the inlet opening 16 is arranged concentrically relative to the shaft 14. The end of the pump housing 15 opposite the inlet opening 16 is closed so that the end of the shaft 14 is received inside the housing 15. By one end of the shaft 14 opening in the inlet opening 16 and the other end of the shaft 14 being received in the pump housing 15, the pump has no seals in the sense that there is no location at which the inner space and the outer space of the pump are separated only by a shaft seal. This has the advantage that discharge of the conveyed medium can be reliably prevented.

In the pump housing 15 there is further received a drive motor which comprises a rotor 19 which is connected to the shaft 14 and a stator 20. The motor is controlled and in particular the speed of the motor is adjusted via an electronic control system 35.

The pump according to the invention comprises two side-channel stages in which an impeller 22 rotates in each case in an operating chamber 23. The impellers 22 have vanes which are arranged in a star-like manner and which have open intermediate vane spaces which are surrounded closely by the housing 15. In a state axially beside the impeller 22, the housing 15 forms a side channel 24 which is open in the direction toward the impeller 22 and in which the conveying medium is conveyed by means of momentum exchange with the impeller 22. The inlet end of the side channel 24 is located opposite an inlet opening of the operating chamber 23, which opening is formed in the housing and cannot be seen in FIG. 1. The medium which enters through the inlet opening arrives through the intermediate spaces of the vanes at the side-channel 24. From the outlet opening of the previous operating chamber 23, a channel 25 which is indicated only schematically in FIG. 1 extends through the pump housing 15 as far as the inlet opening of the following operating chamber 23. The conveyed medium thus passes successively through the two side-channel stages of the pump.

The inlet stage 26 of the pump is configured as a centrifugal stage. An impeller 27 which is connected to the shaft 14 is provided with channels 18 which extend from a central region to a peripheral region of the impeller 27. The medium which is introduced in the central region into the channels 18 is moved outward by means of the centrifugal force. From the outer end of the impeller 27, a channel extends through the pump housing 15 to the inlet opening of the first operating chamber 23.

The pump housing 15 surrounds the operating chambers 23 of the pump and the motor 19, 20 with a spacing so that within the pump housing an annular gap 40 which surrounds the operating chambers 23 and the motor 19, 20 is formed. The outlet side of the second side-channel stage opens in the annular gap 40. The outlet opening 17 of the pump is also connected to the annular gap 40. The medium which is conveyed by the pump therefore moves from the outlet side of the second side-channel stage through the annular gap 40 to the outlet opening 17 of the pump.

The stator 20 of the drive motor is surrounded by an outer pipe 41. The outer pipe 41 extends along the motor and at the same time forms the inner delimitation of the annular gap 40. Toward the inner side, the stator 20 of the drive motor is delimited by an inner pipe 42. The space between the inner pipe 42 and the outer pipe 41 is completely filled by the stator 20. The stator 20 is in direct extensive contact with the inner pipe 42 and the outer pipe 41 so that good heat transmission between the stator 20 and the inner pipe 41 and the outer pipe 42 is ensured. In the region of the end windings 43, the space between the stator 20 and the inner pipe 42 and the outer pipe 41 is filled with a thermally conductive casting compound 47.

Between the drive motor 19, 20 and the electronic control system 35, a plurality of channels 44 extend radially inward from the annular gap 40. The channels 44 open in the motor gap 45 between the rotor 19 and the inner pipe 42 of the stator 20. The motor gap 45 extends over the entire length of the drive motor 19, 20 and merges into a gap 46 which is enclosed between the pump housing 15 and the shaft 14. The gap 46 opens in the operating chamber 23 of the second side-channel stage of the pump and is therefore referred to below as a chamber gap 46.

The channels 44, the motor gap 45 and the chamber gap are components of a cooling circuit which extends from the operating chamber 23 of the second side-channel stage through the annular gap 40, the channels 44, the motor gap 45 and the chamber gap 46 back into the operating chamber 23 of the second side-channel stage of the pump. The cross-section of the cooling circuit is significantly smaller than the cross-section of the outlet opening 17 so that only a small portion of the conveyed medium moves as a cooling medium along the cooling circuit, whilst the larger portion of the conveyed medium leaves the pump through the outlet opening 17.

The cooling medium is kept moving in the cooling circuit by the pressure difference between the outlet side of the second side-channel stage of the pump and the chamber gap 46. The pressure difference corresponds to approximately half of the pressure difference between the inlet side and the outlet side of the second side channel stage of the pump.

The cooling circuit is configured in such a manner that it is in extensive contact with the inner pipe 42 and the outer pipe 41 of the stator 20 and can thereby effectively discharge heat from the stator 20. With the channels 44, the cooling circuit extends between the drive motor 19, 20 and the electronic control system 35 so that at the same time the electronic control system is also cooled. In the motor gap 45, the cooling medium is, except for with the stator 20, in extensive contact with the rotor 19 so that it is also cooled in an effective manner. After it has been returned into the operating chamber 23, the cooling medium is mixed with the conveyed medium which enters through the inlet opening into the operating chamber 23 so that the heat which is absorbed by the cooling medium is distributed in the volume flow.

The cooling circuit is configured in such a manner that the pump according to the invention can be kept at a constant operating temperature during permanent operation when the pump conveys a liquid medium. If the pump instead conveys a gaseous medium, only a smaller quantity of heat is discharged and the pump becomes heated.

In order to nonetheless prevent rapid overheating of the pump, the motor is configured in such a manner that it has a high thermal capacity. Both the rotor 19 and the stator 20 are to this end constructed in a very solid manner. In particular in the stator 20, a high thermal capacity is achieved by the space between the inner pipe 42 and the outer pipe 41 being completely filled. With this configuration of the stator 20, overheating is therefore counteracted in two respects. Firstly, as a result of the solid construction, a large quantity of heat can be absorbed. Secondly, as a result of the extensive contact of the inner pipe 42 and the outer pipe 41 with the cooling circuit, a large quantity of heat can be discharged. It is thereby possible, over a time period, for example, of more than minute, to convey gas without the pump becoming overheated.

An application example of the pump according to the invention is shown in FIG. 2. The pump 28 according to the invention is connected to a liquid gas tank 29. A rising line 31 extends from the lower portion of the tank 29 toward the inlet opening 16 of the pump 28. There is connected to the outlet opening 17 of the pump 28 a line 34 which leads to a vehicle 32 which is intended to be filled with liquid gas 30. The volume flow of the pump is so large that it cannot be completely absorbed by the vehicle 32. In a separator 33, gas bubbles are separated from the volume flow and directed back into the tank 29.

The tank 29 is filled to a level of approximately one third with liquid gas 30. The remaining space in the tank 29 and in the rising line 31 is filled with evaporated liquid gas, the pressure consequently corresponds to the vapor pressure of the liquid gas. If the pump 28 is moved from this state into operation, the liquid gas first enters the pump 28 in the gaseous state. Since, with the application of reduced pressure in the tank 29, liquid gas continues to evaporate, the suction power of the pump in this phase has to be large in order to nonetheless draw liquid gas in the liquid state through the rising line 31. According to the invention, this is achieved by the pump being operated in this phase with an overspeed which is substantially above the operating speed. The overspeed at which the pump is almost operated as a fan may be, for example, 6000 rpm. This speed is substantially above the speed at which the pump can be operated at the maximum level when liquid is conveyed. When conveying liquid, the pump is, for example, operated at a speed of 3000 rpm. The liquid is conveyed with a volume flow of, for example, 35 $m^3/h$.

In spite of the higher speed, the power of the pump when it is operated as a fan is lower than during normal operation in which liquid is conveyed. If a low power is sufficient to accelerate the pump to the overspeed, therefore, the operating chambers 23 of the pump are consequently filled with gas. The control system 35 is consequently configured to operate the electric motor 21 at the overspeed at a low power.

As soon as liquid enters the pump, the resistance suddenly increases and the pump is braked. The control system 35 is configured in such a manner that the power of the electric motor 21 increases as soon as the pump 28 is braked to operating speed in order to keep the pump at this speed. This operating state is maintained until the tank of the vehicle 32 is filled. As soon as this is the case, the pump 28 is switched off.

In the stopped state of the pump, liquid gas which is still contained in the pump continuously evaporates so that the operating chambers 23 after a sufficiently long waiting time return to the initial state again in which they are filled with gas. If another vehicle is intended to be filled, the pump can again at low power be accelerated to the overspeed. However, if the next filling operation takes place before the liquid has evaporated from the pump, the resistance is significantly higher and the pump is operated from the beginning at high power at operating speed so that liquid can be conveyed.

In the alternative embodiment of FIG. 3, the pump housing 15 is provided with two ventilation valves 48 which open in the annular gap 46. The ventilation valves 48 are open as long as gas is conveyed. The ventilation valves 48 close when liquid medium is conveyed. With respect to the embodiment of FIG. 2, the gas discharged through the ventilation valves 48 is directed back into the tank 29 in the same manner as the gas separated with the separator 33.

The invention claimed is:

1. A side-channel pump comprising:

a shaft rotatably supported in a pump housing and driven by a motor;

a plurality of operating chambers arranged within the pump housing, each operating chamber provided with a side channel;

an impeller provided within each of the plurality of operating chambers and rotatable therein, each impeller operatively connected to the shaft; and a cooling circuit extending from one of the plurality of operating chambers to the motor, and from the motor to a suction portion of the side-channel pump, wherein the one of the plurality of operating chambers is connected to an outlet opening of the side-channel pump, wherein the suction portion is arranged in the one of the plurality of operating chambers, and wherein the cooling circuit opens into the one of the plurality of operating chambers via a gap formed between the shaft and a portion of the pump housing surrounding the shaft, wherein the gap is defined by the shaft and the portion of the pump housing.

2. The side-channel pump as claimed in claim 1, wherein the cooling circuit extends between a rotor and a stator of the motor.

3. The side-channel pump as claimed in claim 1, wherein an electronic control system is received in the pump housing and the cooling circuit extends between the motor and the electronic control system.

4. The side-channel pump as claimed in claim 1, wherein an annular gap is formed between the pump housing and the motor.

5. The side-channel pump as claimed in claim 4, wherein the cooling circuit extends through the annular gap.

6. The side-channel pump as claimed in claim 4, wherein the motor is surrounded by an outer pipe and the outer pipe adjoins the annular gap.

7. The side-channel pump as claimed in claim 6, wherein the motor comprises an inner pipe which is arranged between a rotor and a stator of the motor.

8. The side-channel pump as claimed in claim 7, wherein the stator completely fills the space between the inner pipe and the outer pipe over a longitudinal portion of the motor.

9. The side-channel pump as claimed in claim 8, wherein a space which surrounds end windings of the stator is filled with a casting compound.

10. The side-channel pump as claimed in claim 1, wherein the pump housing is provided with a ventilation valve.

11. The side-channel pump as claimed in claim 3, wherein the electronic control system is configured to operate the side-channel pump with an overspeed when the operating chamber of the side-channel pump is filled with gas and to reduce the speed to an operating speed when liquid enters the side-channel pump.

* * * * *